US010674809B2

(12) United States Patent
Peace

(10) Patent No.: US 10,674,809 B2
(45) Date of Patent: Jun. 9, 2020

(54) MULTI-LOBATED PAINT BRUSH AND SLEEVE ASSEMBLY

(71) Applicant: Andrew Evan Peace, Vero Beach, FL (US)

(72) Inventor: Andrew Evan Peace, Vero Beach, FL (US)

(73) Assignee: Stinger Brush Holdings, LLC, Vero Beach, FL (US)

( * ) Notice: Subject to any disclaimer, the term of this patent is extended or adjusted under 35 U.S.C. 154(b) by 213 days.

(21) Appl. No.: 16/029,533

(22) Filed: Jul. 6, 2018

(65) Prior Publication Data

US 2020/0008568 A1 Jan. 9, 2020

(51) Int. Cl.

| | |
|---|---|
| ***A46B 9/02*** | (2006.01) |
| ***A46B 9/06*** | (2006.01) |
| ***A46B 3/12*** | (2006.01) |
| ***A46D 1/00*** | (2006.01) |
| ***A46B 11/00*** | (2006.01) |
| ***A46B 9/10*** | (2006.01) |

(52) U.S. Cl.

CPC ..... *A46B 11/0006* (2013.01); *A46B 3/12* (2013.01); *A46B 9/025* (2013.01); *A46B 9/06* (2013.01); *A46B 9/10* (2013.01); *A46D 1/0238* (2013.01); *A46D 1/0276* (2013.01); *A46B 2200/202* (2013.01)

(58) Field of Classification Search

CPC ..... A46B 11/0006; A46B 3/12; A46B 9/025; A46B 9/06; A46B 9/10; A46B 2200/202; A46D 1/0238; A46D 1/0276

See application file for complete search history.

(56) References Cited

U.S. PATENT DOCUMENTS

| | | | | |
|---|---|---|---|---|
| 2,674,759 A * | 4/1954 | Solberg | ..... | A46B 3/12 15/193 |
| 3,633,234 A | 1/1972 | Henningsen | | |
| 4,041,566 A | 8/1977 | Ford | | |
| 4,062,084 A * | 12/1977 | DuBois | ..... | A46B 9/10 15/169 |
| 4,129,918 A | 12/1978 | Lee | | |
| 4,279,053 A | 7/1981 | Payne et al. | | |

(Continued)

FOREIGN PATENT DOCUMENTS

| | | |
|---|---|---|
| GB | 682725 A | 11/1952 |
| GB | 2094620 A | 9/1982 |

*Primary Examiner* — Weilun Lo

(74) *Attorney, Agent, or Firm* — Mark C. Johnson; Johnson | Delal

(57) ABSTRACT

A multi-lobated brush and sleeve assembly provides a brush having multiple types and sizes of hollow bristles, including a tetraocular filament, a round filament with tipped ends, and a quad filament. The brush as a handle that supports a plurality of independent mobile bristles. The bristles are arranged in a tapered, negative slope configuration having an edge tip defined by an apex. The edge tip surface section of bristles on the left side of the brush are stiffer, enabling cutting capacity and increased paint pickup. A reservoir in the handle contains paint, and feeds the paint through the hollow bristles to the distal free ends for smooth application of paint. A sleeve body may be used separately, or in combination with the brush. The sleeve body encircles the bristles, bunching the bristles together and forming a tapered, tear drop shape at the distal free end of the bristles.

10 Claims, 6 Drawing Sheets

(56) References Cited

U.S. PATENT DOCUMENTS

| | | | | |
|---|---|---|---|---|
| 4,307,478 | A | 12/1981 | Ward et al. | |
| 4,590,637 | A * | 5/1986 | Marino | A46B 9/02 15/160 |
| 5,141,811 | A | 8/1992 | Kawakami et al. | |
| 5,220,702 | A | 6/1993 | Howell | |
| 5,483,721 | A | 1/1996 | Caldwell | |
| 5,507,063 | A * | 4/1996 | Hirsch | A46B 9/02 15/160 |
| 5,786,087 | A * | 7/1998 | Cansler | A46D 1/00 15/159.1 |
| 5,933,908 | A | 8/1999 | O'Brien | |
| 6,367,114 | B1 | 4/2002 | Babkowski | |
| 6,807,704 | B2 | 10/2004 | Nishitani | |
| 7,467,907 | B2 | 12/2008 | Gaynes et al. | |
| 7,854,562 | B2 | 12/2010 | Peterson et al. | |
| 7,913,348 | B2 | 3/2011 | Cox et al. | |
| D767,903 | S | 10/2016 | Lim | |
| 9,642,441 | B1 * | 5/2017 | Ajootian | A45D 40/262 |
| 2005/0273962 | A1 | 12/2005 | Dillon | |
| 2007/0251041 | A1 * | 11/2007 | Errichiello | A46B 5/0075 15/172 |
| 2008/0066253 | A1 * | 3/2008 | Stevens | A46B 11/0093 15/248.1 |
| 2009/0041529 | A1 * | 2/2009 | Gallardo | A46B 5/02 401/266 |
| 2011/0239392 | A1 | 10/2011 | Levy et al. | |
| 2014/0196237 | A1 | 7/2014 | Dale | |
| 2014/0259489 | A1 | 9/2014 | Dale | |
| 2016/0360873 | A1 | 12/2016 | Hobbs | |
| 2017/0224098 | A1 * | 8/2017 | Jones | A46B 9/10 |
| 2017/0332775 | A1 | 11/2017 | Anthony et al. | |

* cited by examiner

MULTI-LOBATED PAINT BRUSH AND SLEEVE ASSEMBLY

FIELD OF THE INVENTION

The present invention relates generally to paint brushes and attachments thereto, and, more particularly, relates to a multi-lobated paint brush and sleeve assembly that provides a brush having a bristle configuration and/or sleeve body that forms a specially designed and functional tip or edge of the brush for user by the user.

BACKGROUND OF THE INVENTION

Generally, a paint brush is comprised of multiple, parallel bristles attached to a handle. In use, a user clasps the handle and manipulates the brush as desired. Typically, the handle is made of wood or plastic. The handle of a typical paint brush has a uniform thickness throughout its length and is of a shape and size that is comfortable to hold and that prevents it from breaking or bending during painting. Paint brush bristles made of synthetic materials have been known for many years. It has long been known that the best synthetic paint brush bristles are those which are tapered.

It is recognized that the time consuming and complex part of painting lies in the detail work. Such work includes corners, trim, molding, windows, utility connections, and so forth. When confronted with such numerous items to paint around, the painter must select an appropriate bristle material (natural or synthetic), a bristle length (1"-5"), a brush end type (chisel trim, square trim, angle trim), and a brush style (angle sash, thin angle sash, and flat sash). This may require use of more than one brush.

Often, a sheath is used for holding and storing a paint brush. The sheath serves to protect the brush bristles and to keep them in their proper alignment and orientation, while allowing them to dry after cleaning. The sheath, however, cannot form the bristles into a desired shape for painting. Typically, paint containers in which paint is stored and sold typically, include a container and a removable lid that forms a secure, air-tight seal with a top edge of the container. The bristles are dipped in a container containing paint and the paint is applied accordingly. To paint a room, multiple dips into the paint container are required.

Therefore, a need exists to overcome the problems with the prior art as discussed above.

SUMMARY OF THE INVENTION

The invention provides a multi-lobated brush and sleeve assembly that overcomes the hereinafore-mentioned disadvantages of the heretofore-known devices and methods of this general type and that provides a brush having multiple types and sizes of hollow bristles, including a tetraocular filament, a round filament with tipped ends, and a quad filament. The bristles are arranged in a tapered, negative slope configuration having an edge tip defined by an apex. The edge tip surface section of bristles on the left side of the brush are stiffer, enabling cutting capacity and increased paint pickup. A reservoir in the handle feeds paint through the hollow bristles for smooth application at their free distal ends.

With the foregoing and other objects in view, there is provided, in accordance with the invention, a brush assembly comprising a handle with a handle first end, a handle second end opposing the handle first end, and a handle gripping surface.

In some embodiments, the brush assembly further comprises a plurality of independently mobile bristles that define a bristle left end and a bristle right end. The bristle right end opposes the left end of the plurality of independently mobile bristles.

In some embodiments, the independently mobile bristles each have a proximal bristle end directly coupled to the handle second end. The mobile bristles extend from the handle second end and terminate at a distal free end. A bristle length separates the proximal bristle end and the distal free end.

Further, the mobile bristles are sectioned into a first plurality of bristles disposed at the bristle left end that defines a longitudinal left end axis. The first plurality of bristles collectively form an edge tip. The edge tip defines an apex disposed at the terminal bristle left end and collectively forming an edge tip surface.

Further, the mobile bristles are sectioned into a second plurality of bristles juxtaposed to the first plurality of bristles and extending from the first plurality of bristles in a transverse direction to the bristle right end, the edge tip surface of the first plurality of bristles span from the apex at a negative slope with respect to the longitudinal left end axis toward the second plurality of bristles.

In one embodiment, the negative slope is linear and oriented at an angle of approximately 49° with respect to the longitudinal left end axis. The bristle length of the first plurality of bristles is longer than the bristle length of the second plurality of bristles.

In accordance with another feature, the first plurality of bristles are of a tetraocular filament.

In accordance with a further feature of the present invention, the second plurality of bristles are of a round filament with tipped ends.

In accordance with a further feature of the present invention, the bristles further include third plurality of bristles surrounded by the first plurality of bristles and the second plurality of bristles.

In accordance with a further feature of the present invention, the third plurality of bristles are of a quad filament.

In accordance with a further feature of the present invention, the first plurality of bristles are stiffer than the second and third plurality of bristles.

In accordance with a further feature of the present invention, the first plurality of bristles disposed at the bristle left end form an arcuate upper surface that includes the apex.

In accordance with a further feature of the present invention, the negative slope is linear and oriented at an angle of approximately 49° with respect to the longitudinal left end axis.

In accordance with a further feature of the present invention, the first, second, and third plurality of bristles are defined by an elongated cavity extending from the proximal bristle end to the distal free end.

In accordance with a further feature of the present invention, the brush assembly further comprises a reservoir disposed in the handle second end, the reservoir being in communication with the elongated cavity of the bristles.

In accordance with a further feature of the present invention, the brush assembly further comprises a ferrule encapsulating at least a portion of the handle second end and the proximal bristle end.

In accordance with a further feature of the present invention, the brush assembly further comprises a ferrule encapsulating at least a portion of the handle second end and the proximal bristle end.

In some embodiments, a sleeve body may be used separately, or in combination with a paint brush having a handle with an end having a plurality of independently mobile bristles each extending therefrom and terminating at a distal free end. The sleeve body encircles the bristles, bunching the bristles together and forming a tapered, tear drop shape at the distal free end of the bristles.

In some embodiments, the sleeve body comprises a sleeve first end that defines and encloses a first aperture. At least one of the handle and the mobile bristles of the brush are disposed in the first aperture.

The sleeve body further comprises a sleeve second end that opposes the sleeve first end. The sleeve second end defines and encloses a second aperture having a tear-drop shape. The sleeve second end of the sleeve body is disposed below the distal free end of the bristles, so as to form a bristle shape corresponding to the tear-drop shape at the sleeve second end. Further, a sleeve channel spans from the first aperture to the second aperture. The plurality of independently mobile bristles are disposed in the sleeve channel.

In accordance with a further feature of the present invention, the bristles comprise a working bristle length separating the sleeve second end of the sleeve body and the distal free end, the bristle shape uniformly spanning the working bristle length.

In accordance with a further feature of the present invention, a perimeter of the plurality of independently mobile bristles defines a bristle area, and further comprising, a second aperture area defined by the second aperture, the second aperture area less than the bristle area.

In accordance with a further feature of the present invention, the sleeve body is of an elastically deformable material.

One objective of the present invention is to provide a paint brush that achieves maximum paint pickup, and provides a smooth application of paint.

Another objective of the present invention is to provide a paint brush having different lengths and stiffness of bristles/filaments strategically patterned for optimal effectiveness.

Another objective of the present invention is to provide brush having multiple types and sizes of hollow bristles, including a tetraocular filament, a round filament with tipped ends, and a quad filament with differing shapes and stiffnesses.

Another objective of the present invention is to provide a paint brush with a stiffer, longer first plurality of bristles to provide a rigid edge on the brush enabling cutting capacity and increased paint pickup.

Another objective of the present invention is to provide a reservoir in the handle feeds paint through the hollow bristles for smooth application at the free distal ends of the bristles.

Yet another objective of the present invention is to minimize the need to dip the bristles into the paint bucket to access fresh paint by feeding the tips of the bristles through the reservoir.

Yet another objective of the present invention is to enable a user to choose from between a tetralocular filament, a quad filament, and a round filament with tipped ends from the same paint brush.

Yet another objective of the present invention is to provide a sleeve body that encircles a portion of the bristles to bunch the distal free end of the bristles into a tapered, tear drop shape.

Yet another objective of the present invention is to provide a painter with the option of three types of filaments from the same paint brush.

Yet another objective of the present invention is to provide an inexpensive to manufacture multi-lobated paint brush and sleeve assembly.

Although the invention is illustrated and described herein as embodied in a multi-lobated paint brush and sleeve assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the handle of the brush.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
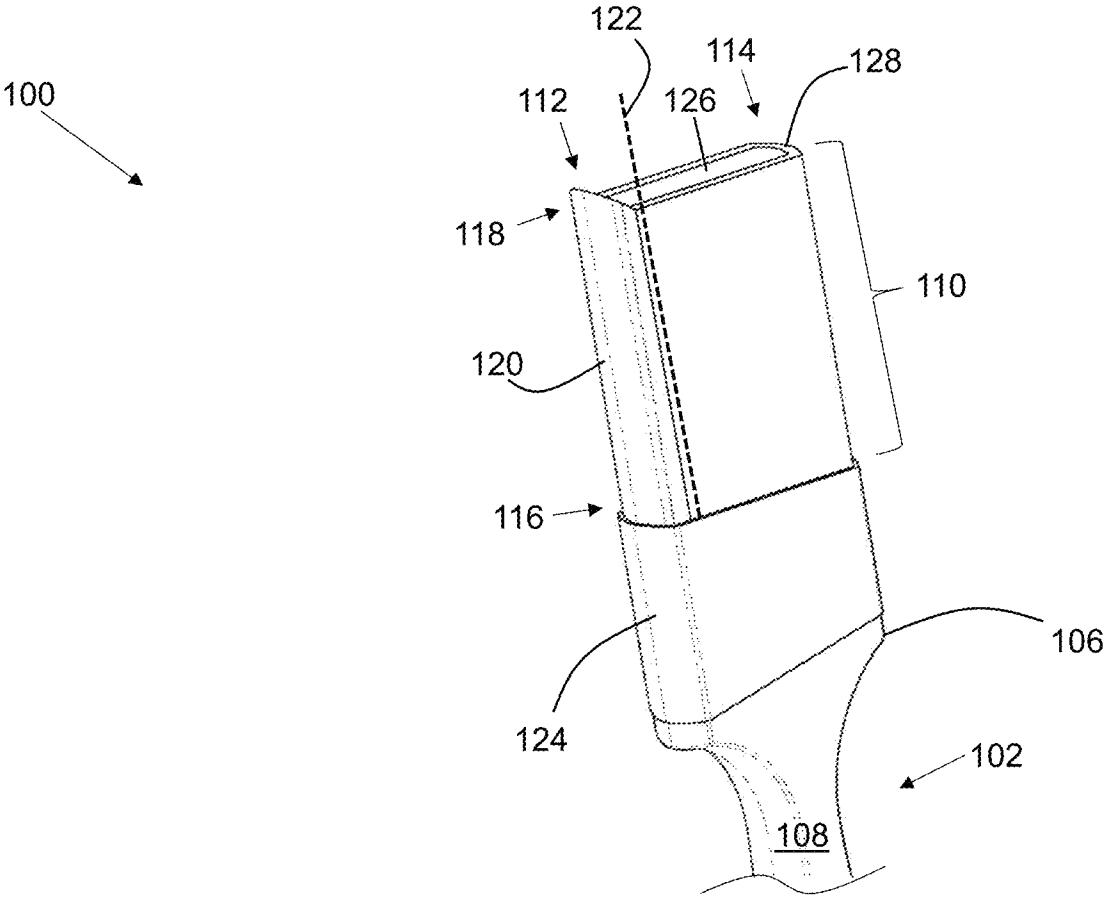
FIG. 1 is a perspective and fragmentary view of an exemplary paint brush assembly, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient multi-lobated brush and sleeve assembly 100. Embodiments of the invention provide a paint brush having multiple lengths and lobes for a plurality of independent, bristles 110 (that may be hollow), or filaments, for painting different structures and surfaces. The bristles 110 include a tetraocular filament, a round filament with tipped ends, and a quad filament arranged strategically relative to each other, so as to achieve optimal paint pickup and application results. A first plurality of bristles 120 are arranged in a tapered, negative slope 400 configuration having an edge tip surface 402 defined by an apex 202. The edge tip surface 402 surface section of bristles on the left side of the brush are stiffer than a second and third plurality of bristles 126, 128; thereby enabling cutting and painting in corners and other hard to reach surfaces.

In addition, embodiments of the invention provide a reservoir 300 in the handle 102 of the paint brush that feeds paint through the hollow bristles 120, 126, 128 to their distal free end 118 for smooth application of paint. This minimizes the need to dip the brush into a paint container to replace paint for the bristles. In additional embodiments, a sleeve body 1200 encircles the bristles 110 to form a tapered, tear drop-shaped distal free end 118 of the bristles.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a multi-lobated brush and sleeve assembly 100, as shown in FIG. 1, includes a handle 102 that is defined by a handle first end 200 (shown best in FIG. 2), and a handle second end 106 opposing the handle first end 200. The handle 102 may have a generally T-shape, so as to provide a handle gripping surface 108 from the handle first end 200, and a mounting surface for bristles from the handle second end 106.

In some embodiments, the handle 102 may be at least partially hollow, so as to form a reservoir 300 for containing paint, as described below. In one non-limiting embodiment, the handle 102 is about 7.6" long, and 0.65" wide. Though other dimensions and shapes may be used. Suitable materials for the handle 102 may include, without limitation, wood, aluminum, metal alloys, and a rigid polymer.

Figure 2:
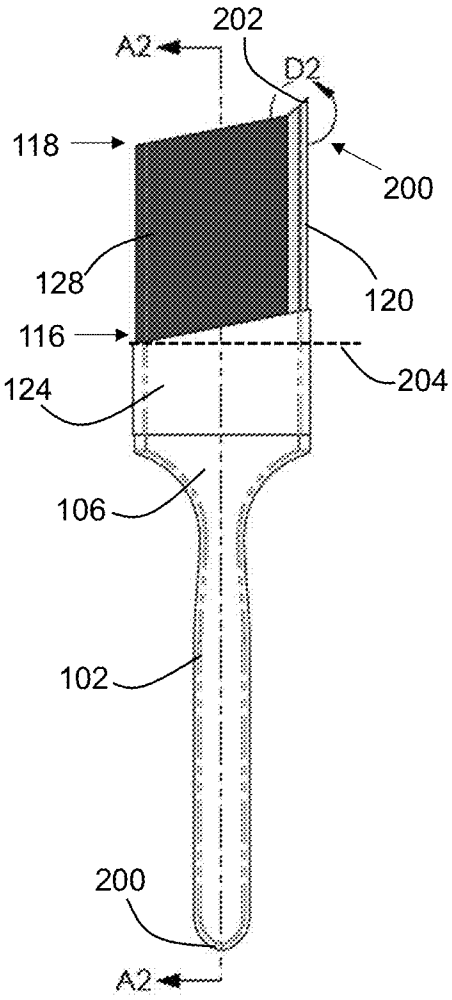
FIG. 2 is an elevated side view of the paint brush assembly shown in FIG. 1, in accordance with the present invention.

As referenced in FIG. 2, the multi-lobated brush and sleeve assembly 100, hereafter "assembly 100" also comprises a plurality of independently mobile bristles 110, or filaments. The bristles 110 are aligned parallel, and densely packed all the way through the ferrule 124. The bristles 110 are configured to optimize the pickup of paint, enhance application of paint onto a surface, and when hollow, carry paint from the reservoir 300 in the handle 102 to distal free end 118. In some embodiments, the bristles 110 may be synthetic bristles are fabricated from nylon, polyester, or a combination of both.

The plurality of independently mobile bristles 110 are collectively defined by a bristle left end 112 and a bristle right end 114. The bristle right end 114 opposes the bristle left end 112. In some embodiments, the distance between the bristle left and right ends 112, 114 is between 1"-5". Though a narrower or wider brush may also be used in other embodiments. The handle 102 is gripped at the handle second end 106 and manipulated to strategically engage the bristles 110 against a surface for painting. The bristle left and right ends 112, 114 may engage the surface separately, or in conjunction to achieve a desired painting technique and application.

Figure 3:
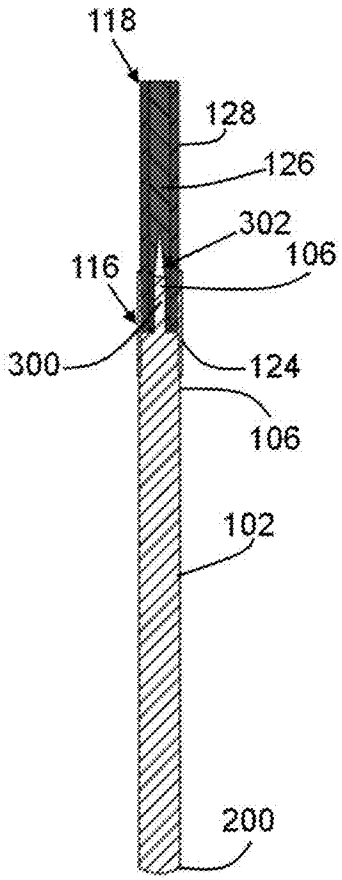
FIG. 3 is a sectioned right-side view of the paint brush assembly, the section taken along section A2-A2 of FIG. 2, detailing the plurality of bristles, in accordance with the present invention.

Looking now at the sectioned view of FIG. 3, the independently mobile bristles 110 each have a proximal bristle end 116 fixedly coupled to the handle second end 106. In some embodiments, the assembly 100 may include a ferrule 124 that encompasses the handle second end 106 and the proximal bristle end 116 to form a fixed relationship therebetween. However, the bristles 110 are still independently mobile, even when attached to the handle 102 through the ferrule 124.

The mobile bristles 110 extend from the handle second end 106 and terminate at a distal free end 118. A bristle length separates the proximal bristle end 116 and the distal free end 118. The bristles 110 are unique in that they do not share the same length or lobe structure. In one embodiment, the bristles on the left side are longer than the bristles in the center and right side. Also, the left-side bristles are stiffer, as discussed below.

Figure 4:
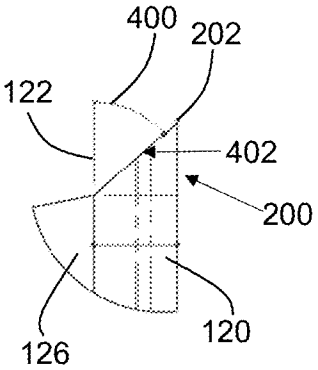
FIG. 4 is an elevated side view of the first plurality of bristles, the section taken along section D2 of FIG. 2, detailing an apex of the first plurality of bristles, in accordance with the present invention.
Figure 5:
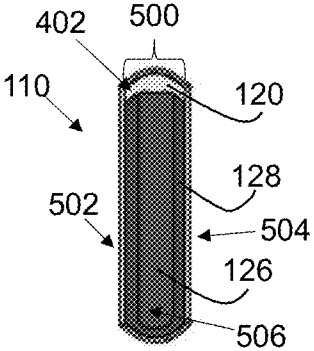
FIG. 5 is a top view of a plurality of independently mobile bristles, in accordance with the present invention.

Looking now at FIGS. 4-5, the mobile bristles 110 are sectioned into a first plurality of bristles 120. The first plurality of bristles 120 extend from the handle 102, at the bristle left end 112. In one non-limiting embodiment, the first plurality of bristles 120 are about 3.12" long. The bristle left end 112 defines a longitudinal left end axis 122 that runs parallel to the first plurality of bristles 120 (FIG. 2). The first plurality of bristles 120 collectively form an edge tip surface 402. The edge tip surface 402 defines an apex 202 disposed at the terminal bristle left end 112 and collectively forming an edge tip surface 402. As shown in FIG. 4, the edge tip surface 402 extends further than the other bristles, forming a stiff, elongated first plurality of bristles 120. FIG. 5 also depicts the mobile bristles 110 defining a front surface 502 separating the bristle left and right ends and collectively defining a rear surface 504 opposing the front surface 502 and separating the bristle left and right ends 112, 114. FIG. 5 also depicts the distal free end surfaces 506 of the second and third plurality of bristles 126, 128 of the mobile bristles 110. As also seen in FIG. 5, the plurality of independently mobile bristles 110 can be seen forming an oblong shape when viewed from the distal free end surfaces thereon. With reference to FIGS. 1-2 and FIG. 4, the distal free end surface 506 of the second plurality of bristles 126 can be seen spanning from the longitudinal left end axis 122 at a negative slope with respect to and toward the bristle right end 114, wherein the first plurality of bristles 120 are more stiff than the second plurality of bristles 126 and the negative slope of the first plurality of bristles 120 is steeper than the negative slope of the second plurality of bristles 126.

Figure 6:
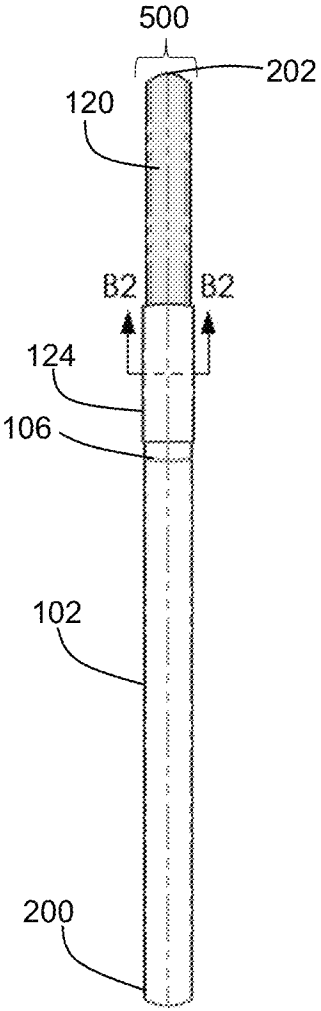
FIG. 6 is a sectioned left side view of the paint brush assembly, the section taken along section A2-A2 of FIG. 2, detailing the plurality of bristles, in accordance with the present invention.
Figure 9:
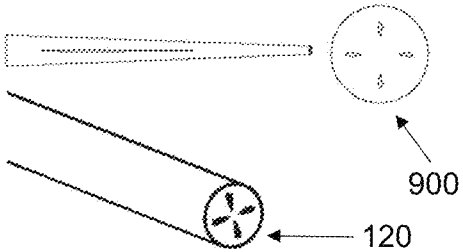
FIG. 9 is a perspective view of the first plurality of bristles having a tetraocular-shaped filament, in accordance with the present invention.

As FIG. 6 illustrates, the first plurality of bristles 120 that are disposed at the bristle left end 112 form an arcuate upper surface 500 that includes the apex 202. The arcuate shape creates a fine point for fine application of paint, penetrating tight corners, and cutting through restricted surface areas. For example, the apex 202 is particularly well-suited for cutting in around the perimeter of a room. The first plurality of bristles 120 are stiffer than the second and third plurality of bristles 126, 128, as discussed below. This is at least partially possible because of the tetraocular shape of the first plurality of bristles 120 (FIG. 9). As seen in FIG. 1 and FIGS. 5-6, the first plurality of bristles 120 can also be seen solely defining the bristle left end 112 to define the longitudinal left end axis 122 and collectively forming the edge tip defining the apex 202 disposed at the terminal bristle left end and collectively forming the edge tip surface 402 which spans around the terminal bristle left end 112 and to and from the front and rear surfaces 502, 504.

In one non-limiting embodiment shown in FIG. 9, the first plurality of bristles 120 comprise tetraocular filaments 900. Those skilled in the art will recognize that tetraocular filaments 900 provide excellent bend recovery. This can be useful for maintain the stiff configuration at the edge tip surface 402. The first plurality of bristles 120 may be fabricated from 100% polyester.

The stiffer edge tip surface 402 and arcuate shape of the first plurality of bristles 120 are effective for cutting or penetrating tight corners. Thus, the assembly 100 provides a paint brush with a stiffer, longer first plurality of bristles 120 to provide a rigid edge on the brush enabling cutting capacity and increased paint pickup. Additionally, the first plurality of bristles 120 may be hollow for carrying paint form a reservoir 300, as discussed below.

Figure 8:
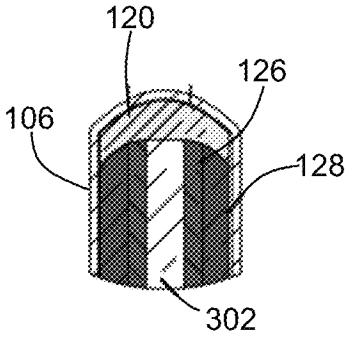
FIG. 8 is a top view of a plurality of independently mobile bristles, the section taken along section C2 of FIG. 7, in accordance with the present invention.
Figure 7:
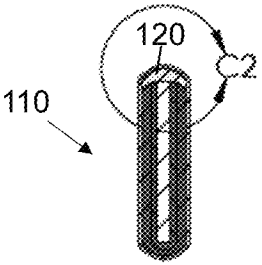
FIG. 7 is a top view of the independently mobile bristles, in accordance with the present invention.

Turning now to FIG. 8, the mobile bristles 110 are sectioned into a second plurality of bristles 126 juxtaposed to the first plurality of bristles 120. The second plurality of bristles 126 extend from the first plurality of bristles 120 in a transverse direction to the bristle right end 114. Specifically, the edge tip surface 402 surface of the first plurality of bristles 120 span from the apex 202 at a negative slope 400 with respect to the longitudinal left end axis 122 toward the second plurality of bristles 126. As a result, the bristle length of the first plurality of bristles 120 is longer than the bristle length of the second plurality of bristles 126.

As shown in FIG. 2, the second plurality of bristles 126 are disposed at an angle relative to a horizontal axis 204. In one non-limiting embodiment, the angle is about 11°. This creates a tapered arrangement of bristles 126, 128. The second plurality of bristles 126 may apply paint independently, or in conjunction with the first plurality of bristles 120. In some embodiments, the second plurality of bristles 126 are hollow.

The negative slope 400 and length inequity of the first plurality of bristles 120 creates a tapering effect that provides additional paint-application options for the creative painter. The handle 102 can be manipulated between the first and second plurality of bristles 120, 126 to achieve a desired application. In some embodiments, the negative slope 400 is linear and oriented at an angle between 35°-55° with respect to the longitudinal left end axis 122. However, in one non-limiting embodiment, the negative slope 400 is approximately 49° with respect to the longitudinal left end axis 122.

Figure 11:
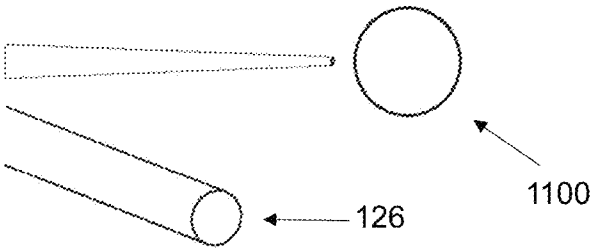
FIG. 11 is a perspective view of the second plurality of bristles having a round shaped filament with tipped ends, in accordance with the present invention.

In one non-limiting embodiment shown in FIG. 11, the second plurality of bristles 126 are of a round filament with tipped ends 1100. The second plurality of bristles 126 may be fabricated from a nylon polyester blend. Those skilled in the art will recognize that a round filament with tipped ends 1100 are durable. Also, the tipped ends of the round filament provide a smooth application of paint, and the finest finish of the three filaments used by the bristles. It is also known that the round filament also aids in edge control and provides longer strokes when applying paint. This can be effective for painting large, flat surfaces, such as a wall.

As FIG. 8 references, the assembly 100 introduces yet another set of bristles, different than the first and second plurality of bristles 120, 126. A third plurality of bristles 128 join at the handle second end 106, similar to first and second plurality of bristles 120, 126. The third plurality of bristles 128 can be seen surrounding the second plurality of bristles 126. The third plurality of bristles 128 may apply paint in conjunction with the first and second plurality of bristles 120, 126.

Figure 10:
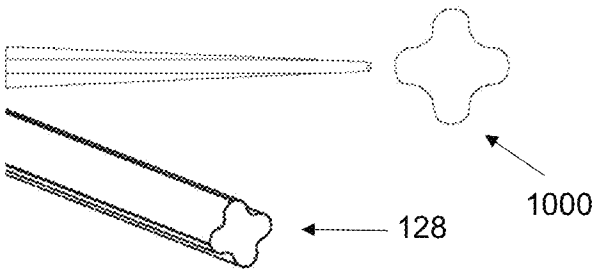
FIG. 10 is a perspective view of the third plurality of bristles having a quad shaped filament, in accordance with the present invention.

In some embodiments, the third plurality of bristles 128 are hollow, and fabricated from a nylon polyester blend. In one non-limiting embodiment shown in FIG. 10, the third plurality of bristles 128 are of a quad filament 1000. Those skilled in the art will recognize that the quad-like shape of the quad filament 1000 optimizes paint pickup. Quad filaments are also easy to clean and add stiffness to the bristles. In this manner, the third plurality of bristles 128 are adapted to apply paint into corners, up to adjacent surfaces, or along narrow edges or surfaces.

In one embodiment, the assembly 100 provides a paint brush having different lengths and stiffness of bristles strategically patterned for optimal effectiveness. The sloped distal free ends 118 of the first plurality of bristles 120, in conjunction with the different lobe-styles of the first, second, and third bristles 120. 126. 128 creates multiple, convenient paint application options. For example, the handle 102 can be manipulated so that the stiff, tetralocular-shaped first plurality of bristles 120 are dabbed into a tight corner. The stiffness of the first plurality of bristles 120 does not allow them to bend in the corner, which creates a uniform application of paint therein.

The second plurality of bristles 126 may then be applied across a different surface than the first plurality of bristles 120. For example, the handle 102 is swept to the right, enabling the second plurality of bristles 126 to apply paint across a large, flat surface. The round filaments with tipped ends 1100 apply the smoothest coat of paint, and thus would be effective across the flat surface. The third plurality of bristles 128 may then be used to paint the ceiling, as the quad filament 1000 is effective for retaining more paint. The third plurality of bristles 128 are also effective for dabbing at a surface, and leaving the unique quad-shape on the surface. In this manner, the bristles provide a paint brush that achieves maximum paint pickup, and provides a smooth application of paint.

The brush assembly 100 is also unique in that paint can be applied directly from the bristles 110 without the need to dip into a paint source. This is accomplished through use of a reservoir 300 in the handle 102 and hollow versions of the bristles. In this embodiment, the first, second, and third plurality of bristles 120, 126, 128 are defined by an elongated cavity 302 extending from the proximal bristle end 116 to the distal free end 118. The handle second end 106 is defined by the reservoir 300, which is in communication with the elongated cavity 302 running through the bristles 120, 126, 128.

Upon filling the reservoir 300 with paint, the paint flows along the length of the bristles from the proximal bristle end 116 to the distal free end 118. The flow of the paint may be induced by weight and gravity, as the handle 102 is flipped over to enable flowage of paint from the higher gradient of the reservoir 300 to the lower gradient at the distal free end 118 of the bristles 110. Then at the distal free end 118, the paint flows out of the bristles and onto the surface. This minimizes the need to dip the bristles into the paint bucket to access fresh paint by feeding the tips of the bristles through the reservoir 300. In one alternative embodiment, a purging means, such as a small pump, may be used to force flowage of the paint from the reservoir 300. The purging means may be useful for forcing low viscosity paints from the reservoir.

Figure 12:
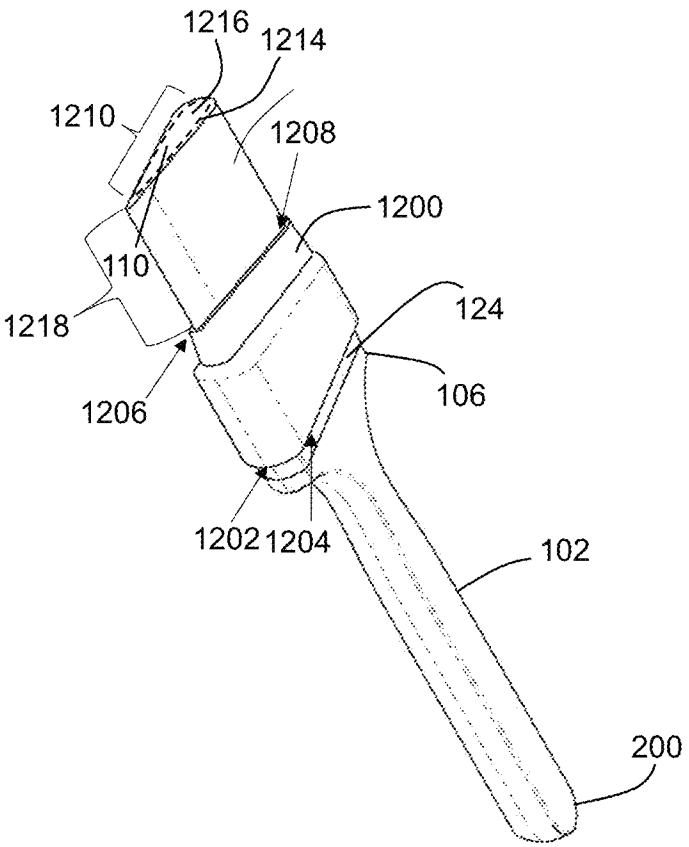
FIG. 12 is a perspective view of an exemplary sleeve body enclosed around a paint brush, in accordance with the present invention.
Figure 13:
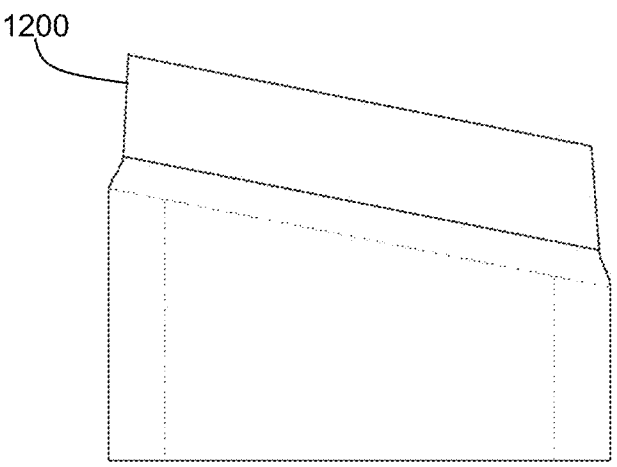
FIG. 13 is a left side view of a sleeve body, in accordance with the present invention.

Turning now to FIGS. 12 and 13, the assembly 100 further comprises a sleeve body 1200 that slidably encloses at least a portion of the bristles 110 and handle 102 to form the bristles into a tapered, tear drop shape, efficacious for painting a surface. The sleeve body 1200 encircles the bristles 110, bunching the bristles together and forming a tapered, tear drop shape at the distal free end 118 of the bristles 110.

However, the sleeve body 1200 may also be used to protect the brush bristles and to keep them in their proper alignment and orientation, while allowing them to dry after cleaning. The sleeve body 1200 may be used to encapsulate the bristles discussed above, or used with a standard paintbrush known in the art. For these dual purposes, the sleeve body 1200 is fabricated from an elastically deformable material.

The sleeve body 1200 comprises a sleeve first end 1202 that defines and encloses a first aperture 1204. When the sleeve body 1200 is applied to the bristles 110, the sleeve first end 1202 is proximal to the handle second end 106. At least one of the handle 102 and the mobile bristles 110 of the brush are disposed in the first aperture 1204. The first aperture 1204 may have a generally oval shape. Though a tear drop shape may also be formed from the first aperture 1204.

Figure 14:
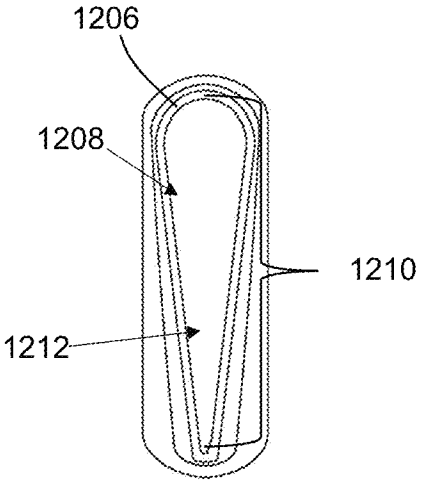
FIG. 14 is a top view looking down at the sleeve second end of the sleeve body, in accordance with the present invention.

The sleeve body 1200 further comprises a sleeve second end 1206 that opposes the sleeve first end 1202. When the sleeve body 1200 is applied to the bristles 110, the sleeve second end 1206 is distally disposed from the handle second end 106. As illustrated in FIG. 12 and FIG. 14, the sleeve second end 1206 defines and encloses a second aperture 1208 having a tear-drop shape. The sleeve second end 1206 is disposed below the distal free end 118 of the bristles, so as to form the bristle 110 into a shape corresponding to the tear-drop shape of the sleeve second end 1206. The edge of the sleeve second end 1206 may also be sloped to create a tapered effect at the distal free end 118 of the bristles 110.

Further, a sleeve channel 1212 spans from the first aperture 1204 to the second aperture 1208 of the sleeve body 1200. The plurality of independently mobile bristles 110 are disposed in the sleeve channel 1212. The sleeve body 1200 tapers along the sleeve channel 1212, such that one end of the sleeve is narrower than an opposing end of the sleeve, i.e., a tear-drop shape is generated.

In some embodiments, the bristles comprise a working bristle length 1218 separating the sleeve second end 1206 of the sleeve body 1200 and the distal free end 118. The tear drop bristle shape uniformly spans the working bristle length 1218. Further, a perimeter 1214 of the bristles 110 defines a bristle area 1216. The second aperture 1208 in the sleeve body 1200 defined a second aperture area 1210 that is less than the bristle area 1216. This maintains the bristles in a compact, tear drop shape inside the enclosure of the sleeve channel 1212.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A paint brush assembly comprising:

a handle with a handle first end, a handle second end opposing the handle first end, and a handle gripping surface; and a plurality of independently mobile bristles defining a bristle left end and a bristle right end, opposing the left end of the plurality of independently mobile bristles, the plurality of independently mobile bristles:

defining a front surface separating the bristle left and right ends and defining a rear surface opposing the front surface and separating the bristle left and right ends;

each with a proximal bristle end directly coupled to the handle second end, extending from the handle second end and terminating at a distal free end, and with a bristle length separating the proximal bristle end and the distal free end;

sectioned into a first plurality of bristles disposed at and solely defining the bristle left end to define a longitudinal left end axis and collectively forming an edge tip defining an apex disposed at a terminal bristle left end and collectively forming an edge tip surface spanning around the terminal bristle left end and to and from the front and rear surfaces; and sectioned into a second plurality of bristles juxtaposed to the first plurality of bristles, defining, with the first plurality of bristles, the longitudinal left end axis, defining a distal free end surface at the distal free end thereon, and extending continuously from the first plurality of bristles in a transverse direction to the bristle right end, the edge tip surface of the first plurality of bristles spanning from the apex at a negative slope with respect to the longitudinal left end axis and toward the second plurality of bristles with the bristle length of the first plurality of bristles longer than the bristle length of the second plurality of bristles and the distal free end surface of the second plurality of bristles spanning from the longitudinal left end axis at a negative slope with respect to and toward the bristle right end, wherein the first plurality of bristles are more stiff than the second plurality of bristles and the negative slope of the first plurality of bristles is steeper than the negative slope of the second plurality of bristles.

2. The brush assembly according to claim 1, wherein:

the first plurality of bristles are of a tetraocular filament.

3. The brush assembly according to claim 1, wherein:

the second plurality of bristles are of a round filament with tipped ends.

4. The brush assembly according to claim 1, wherein the plurality of independently mobile bristles further comprise:

a third plurality of bristles surrounding the second plurality of bristles.

5. The brush assembly according to claim 4, wherein:

the third plurality of bristles are of a quad filament.

6. The brush assembly according to claim 5, wherein:

the first plurality of bristles are more stiff than the second and third plurality of bristles.

7. The brush assembly according to claim 6, wherein:

the first plurality of bristles disposed at the bristle left end form an arcuate upper surface that includes the apex.

8. The brush assembly according to claim 1, wherein:

the negative slope of the first plurality of bristles is linear and oriented at an angle of approximately 49 degrees with respect to the longitudinal left end axis.

9. The brush assembly according to claim 1, further comprising:

a ferrule encapsulating at least a portion of the handle second end and the proximal bristle end.

10. The brush assembly according to claim 1, wherein:

the plurality of independently mobile bristles form an oblong shape at the distal free surfaces thereon.

* * * * *